US011628331B1

(12) United States Patent
Loebbecke

(10) Patent No.: US 11,628,331 B1
(45) Date of Patent: Apr. 18, 2023

(54) EXERCISE TOOL

(71) Applicant: Keith J. Loebbecke, Castro Valley, CA (US)

(72) Inventor: Keith J. Loebbecke, Castro Valley, CA (US)

( * ) Notice: Subject to any disclaimer, the term of this patent is extended or adjusted under 35 U.S.C. 154(b) by 379 days.

(21) Appl. No.: 17/062,898

(22) Filed: Oct. 5, 2020

Related U.S. Application Data

(60) Provisional application No. 62/910,883, filed on Oct. 4, 2019.

(51) Int. Cl.
*A63B 23/02* (2006.01)
*A63B 21/00* (2006.01)

(52) U.S. Cl.
CPC .... *A63B 21/4039* (2015.10); *A63B 21/00047* (2013.01); *A63B 21/4035* (2015.10); *A63B 23/0216* (2013.01); *A63B 2208/0247* (2013.01); *A63B 2208/0252* (2013.01)

(58) Field of Classification Search
CPC ..... A63B 21/00047; A63B 21/4035; A63B 21/4039; A63B 23/0205; A63B 23/0211; A63B 23/0222; A63B 23/0227; A63B 2208/0247; A63B 2208/0252
See application file for complete search history.

(56) References Cited

U.S. PATENT DOCUMENTS 5,545,114 A * 8/1996 Gvoich ..... A63B 21/4011 482/142
5,997,450 A * 12/1999 Wilkinson ..... A63B 21/151 601/24
11,446,540 B2 * 9/2022 Lagree ..... A63B 22/0089
2008/0207412 A1 * 8/2008 Lin ..... A63B 21/4049 482/140
2009/0227435 A1 * 9/2009 Pandozy ..... A63B 21/0616 482/142
2009/0305855 A1 * 12/2009 Terrell ..... A63B 21/4047 482/140
2013/0203566 A1 * 8/2013 Finestein ..... A63B 21/012 482/114
2014/0011644 A1 * 1/2014 Ho ..... A63B 23/0216 482/96
2014/0121079 A1 * 5/2014 Lagree ..... A63B 21/00065 482/139
2015/0196798 A1 * 7/2015 Baschnagel ..... A63B 22/18 482/140
2017/0043206 A1 * 2/2017 Wilson ..... A63B 23/0211
2018/0207470 A1 * 7/2018 Duffy ..... A63B 21/0442
2019/0308066 A1 * 10/2019 Rusch ..... A63B 21/4037

* cited by examiner

*Primary Examiner* — Joshua Lee
(74) *Attorney, Agent, or Firm* — Heisler & Associates

(57) ABSTRACT

The exercise tool includes a rigid base with a torso support extending up from a central portion of the base, and with a pair of handles extending up from lateral portions of the base. The torso support includes padding on at least an upper portion thereof. The padding is contoured to have a non-planar upper surface. The handles can be gripped by fingers of a user while the user rests a backside of a torso of the user upon the torso support, and leg and hip lifting and lowering exercises can be performed. In one embodiment, the handles include multiple separate bars in different orientations to facilitate optimal hand gripping. The exercise tool can be utilized for a large number of exercises with then tool supporting hands, feet, and/or torso or other body portions which benefit from being supported above ground while performing various exercises.

18 Claims, 4 Drawing Sheets

EXERCISE TOOL

CROSS-REFERENCE TO RELATED APPLICATIONS

This application claims benefit under Title 35, United States Code § 119(e) of U.S. Provisional Application No. 62/910,883 filed on Oct. 4, 2019.

FIELD OF THE INVENTION

The following invention relates to exercise tools to help a user in performing various exercises. More particularly, this invention relates to exercise tools which have a generally static form and rest upon the ground, and include structures thereon for supporting at least one portion of a body of a user while performing various exercises.

BACKGROUND OF THE INVENTION

Tools for assistance with exercise come in a variety of configurations. Many such tools are in the form of mechanisms, either powered or unpowered, with multiple moving parts which provide an interface between the ground and an exercising individual interacting with such a mechanism with multiple moving parts. Examples of such multiple moving part exercise mechanisms include stationary bicycles, elliptical trainers, rowing machines, treadmills, stair-step type devices and multiple other complex mechanisms with moving parts.

Other exercise devices are static structures with which the exercising individual interacts, either without additional equipment, or perhaps with only weights as additional equipment. Examples of such static structures include workout benches of various shapes and sizes and pull up/chin up bars. Such static structures can be mounted to a floor or to a wall or other structure, or can be mobile, with such mobility either being freely allowed, such as with exercise balls, or with movement resisted, such as by static structures with a base which engages the ground in a manner which resists movement thereof.

Many exercise regimens can be pursued without any exercise devices provided for assistance. Exercises which are often achieved without the assistance of any exercise devices include push-ups, squats, and various different aerobic exercises as well as strength training exercises which use the body's weight working against gravity for strength and fitness improvement.

Many exercise regimens, while performable at a basic level without any associated exercise devices, can be enhanced if a static structure is provided to enhance the exercise regimen. For instance, while crunches and other "sit up" type exercises can be performed without any assistance of any static structures or other exercise devices, it can be beneficial to anchor one's feet. In many other instances, it is beneficial to utilize exercise devices to anchor a portion of the body more securely while other portions of the body are moved.

It has been discovered that the lower abdomen is difficult to work out for strength increase, body definition and flexibility with mere utilization of an exercise regimen alone. Strengthening of the lower abdomen can be effectively achieved with exercises that caused the lower body to be placed lower than or higher than the torso, in a manner which is difficult to achieve when merely working out on a flat surface beneath the exercising individual. Also, being able to securely support the torso of an exercising individual slightly above an underlying surface, allows for isolating of the muscles of the lower abdomen, and to strengthen those muscles by positioning of the lower body below and above the torso. Such elevating of the torso slightly above ground also allows for strengthening of lateral muscles of the lower torso through various twisting motions and pivoting motions which are difficult or impossible to achieve when merely exercising upon a flat surface.

Furthermore, some individuals have lower back or other torso injuries which can limit the degree to which the lower abdomen can be exercised. However, if the back and torso of the individual is adequately supported, some exercises can be facilitated which would otherwise not be possible or desirable to perform.

Accordingly, a need exists for an exercise device which supports the torso slightly above ground and allows for an exercising individual to be adequately supported at the torso for performance of exercises to strengthen and generally improve the lower torso. Beneficially, such an exercise device would also facilitate other exercises for strengthening of other portions of the individual, so that the device becomes a multi-purpose exercising tool, not only facilitating lower torso strengthening and development exercises, but being useful for other exercises more generally.

SUMMARY OF THE INVENTION

With this invention, an exercise tool is provided which is specially configured for enhancing the lower abdomen, with a simple static body support tool which can rest upon a typically flat underlying surface. The tool, in an example depicted herein as a representative embodiment, includes a base which is preferably planar and has a lower/bottom surface which can rest upon an underlying surface, such as the ground, and an opposing upper/top surface upon which other body support structures are located. The base is preferably formed of a rigid material and particularly features a central portion upon which a torso support structure can be supported, and two lateral portions which extend in a left and right direction from the central portion, with each lateral portion supporting a separate handle assembly, primarily (but not exclusively) for arm support.

The two handle assemblies are preferably mirror images of each other and are primarily provided to engage left and right hands of an exercising user. In some embodiments, it is conceivable that the handles could be provided for engagement with feet of a user, at least for some exercises. Each handle preferably includes vertical posts extending up from interfaces which are attached to the base. These posts preferably extend vertically up from the base for a distance similar to a spacing between the two vertical posts. In one embodiment, this spacing is approximately 6 inches, but could be any of a variety of different dimensions including the dimensions depicted in the included drawings, such as 177.8 mm in this representative embodiment.

A stiffener is preferably provided which is oriented parallel and adjacent with the base and with which the interfaces of the handles engage. This stiffener helps to spread forces, which can be significant, between the handles and the base, associated with weight of the exercising individual and other forces applied but an exercising individual upon the handles, and to some extent to other portions of the exercise tool.

Most preferably, three separate bars extend substantially within horizontal planes between the two vertical legs of each handle. These three separate bars include a top bar joining uppermost portions of the legs together, a parallel bar and an angled bar. The parallel bar and angled bar are preferably located at a common elevation below the top bar and oriented within a plane which is parallel with a plane in which the top bar is oriented. The parallel bar is closer to a head of an exercising individual, when the exercising individual is laying supine upon the torso support portion of the exercise tool. The parallel bar preferably extends along a line which is parallel with the line along which the top bar extends.

However, the angled bar, which is further from a head of the user when the user lies upon the torso support portion of the exercising tool in a supine position, is angled relative to the top bar and the parallel bar. This angling is in one embodiment 42° away from an orientation which would be parallel with the top bar and the parallel bar. Two short arms position each end of the parallel bar away from the posts of each handle. One short bar also supports one end of the angled bar spaced away from an outer one of the posts, while the opposite end of the angled bar is directly coupled to an inner one of the posts.

Preferably each of the posts and each of the bars, as well as the arms, are circular in cross-section. Elbows/bends between the arms and the bars are also preferably rounded. The handles can thus present smooth surfaces in all directions. Central portions of each of the bars are preferably fitted with grips. These grips are preferably formed of resilient material, while the bars, arms and posts are all formed of rigid material. In one embodiment, the material forming the posts, arms and bars is aluminum, while the grips are formed of a rubber material or other resilient material with characteristics similar to a rubber of medium hardness.

The grips provide a high friction and soft surface against which hands of a user can grip, to securely hold onto the handles when utilizing the exercise tool of this invention. Typically exercises are performed while the exercising individual is supine upon the exercise tool, with each of the handles being gripped by hands of the individual. As an alternative, when performing some exercises, such as standard push-ups, the exercising individual could interface with the exercise tool and especially the handles in a prone position and utilizing the same two handles.

When performing various different exercises, in one embodiment an exercising individual merely picks the bar and grip which are most comfortable for performing exercise. In other embodiments, the exercising individual is guided to use particular bars and/or grips so that a particular muscle group (or groups) can be most effectively enhanced. It is also conceivable that some exercises could be performed utilizing only one of the handles, or in perhaps some instances utilizing neither of the handles. Further details of the handles are described in the included figures.

A torso support is provided on a central portion of the upper/top surface of the base. This torso support includes a frame fixed to a central portion of the base and extending upward from the upper surface thereof. This frame includes a top plate of planar form and with a series of fenestrations formed therein. This top plate is preferably angled slightly, and in one embodiment is angled so that when a top end of the frame closest to a head of an individual resting supine over the frame has a height of 162.9 mm, while the bottom end of the frame opposite the top end and most distant from a head of a user oriented supine upon the tool, has a height of 104.7 mm, and when the top end and the bottom end are spaced 308.8 mm from each other. Thus, the top plate is slanted somewhat and with a top end closer to a head of an individual resting supine over the exercise tool elevated higher above the base than the bottom end of the top plate. However, both ends of the top deck are elevated significantly above the base.

A pair of lateral opposing side walls/risers form a perimeter of the torso support frame along with a top wall at the top end and the bottom wall at the bottom end. Each of these walls typically extends vertically down from the top plate to lower edges. The lower edges are preferably affixed to a central portion of the upper surface of the base in a rigid fashion. The torso support frame is preferably formed of rigid material, such as steel, with sufficient support to carry an entire weight of an individual who is utilizing the exercise tool. Most preferably, the torso support frame is fixed to the base of the exercise tool in a fixed manner. As one alternative, the torso support frame could be pivotable so that an angle of the top plate could be adjusted. Such adjustment might allow for the torso support frame on the exercise tool to accommodate individuals of different sizes, or to accommodate some exercises better in different positions.

A padding structure overlies the torso support frame. This padding is preferably formed of resilient material formed of rubber or material having similar hardness characteristics as a medium hard rubber. Various different materials could be utilized for the padding. The padding could be open cell or moisture absorbent, and removable for washability, or could be formed of closed cell type material which does not absorb moisture, so that merely wiping of the surface would clean the padding. The padding could be removable for replacement with padding having different hardnesses or different amounts of padding thickness associated therewith. The padding could be removable so that if damaged it could be replaced without requiring replacement of the entire exercise tool. To some extent, an angle of an upper surface of the padding could be adjusted by swapping different padding assemblies.

Typically, each padding structure includes an upper saddle surface which has a greater elevation at lateral sides than in a central portion. This upper saddle surface acts as a surface to bear directly against a lower back of an exercising individual resting supine upon the exercise tool. Preferably, the upper saddle surface has an angle which generally matches an angle of the top plate of the torso support frame, so that padding is of a similar thickness above the torso support frame along the midline of the saddle surface extending down to the torso support frame. However, lateral portions of the upper saddle surface have a greater thickness than central portions, to form the saddle structure and to cradle the lower back of the exercising individual.

The padding also preferably includes a rim defining a perimeter of the top saddle surface which is rounded somewhat and transitioning into a perimeter wall/skirt which preferably extends approximately vertically between the upper saddle surface and toward the base. An inner hollow core is inboard of the padding and is shaped similar to the torso support frame. By placing fenestrations within the top plate of the torso support frame, breathability of the padding through a lower surface thereof can be accommodated somewhat. The fenestrations also decrease a weight of the top plate to decrease an overall weight of the exercise tool somewhat. While the inner hollow core preferably matches a shape of the torso support frame exactly, it is conceivable that the hollow core could be oversized somewhat, especially adjacent a perimeter wall/skirt of the padding, and still function effectively according to this invention. The padding preferably is a unitary mass of material formed of a similar resilient structure. However, the padding could as an alternative have different portions which have different hardnesses.

With reference to the above description, it can be envisioned that this invention can be used for a variety of different exercises. While most of the exercises involve the base resting upon a horizontal underlying surface, the exercise tool could conceivably be utilized with the base resting against a wall or resting against an angled surface, or with the base freely in the air. For instance, the entire exercise tool could be utilized for a curling exercise while an individual is standing or sitting, or could be utilized by placing the base against a vertical wall or other surface while a user engages the exercise tool through the handles and hands/fingers of the exercising individual.

When the exercise tool is resting upon the ground, or some other surface, a variety of lower abdominal exercises and other exercises which can be performed is extensive, and perhaps only limited by the imagination of the exercising individual. Examples of such exercises include: reverse crunch (no weight and weighted); reverse crunch-cross legged; upper crunch (no weight and weighted); twisting sit ups; side crunch (no weight and weighted); weighted Russian twist (no weight and weighted); flutter kicks (no weight and weighted); dragon flag variation flutter kicks (no weight and weighted); jack knives (no weight and weighted); jack knives bent knees (no weight and weighted); bicycles (no weight and weighted); plank and knees to chest (no weight and weighted); plank-one leg lift (no weight and weighted); plank-rotation and extension; plank-weighted; plank-single arm; plank-side crunches; plank-reverse hip lift; plank jacks; bird dog plank; leg circles (no weight and weighted); Swiss ball jack knife; slider knee pike; cross body climber (no weight and weighted); jack knife-cross leg (no weight and weighted); reverse medicine ball plank; medicine ball float; superman; superman with medicine ball; push-ups; back arm; and curls.

The exercises can be repeated for a number of repetitions which are selected either by the individual or a training instructor. When weight is added, the weight could be in the form of ankle weights, weights resting upon an abdomen of the individual, or weights carried between the abdomen and upper legs of the individual. The weights can be attached to the individual or carried by balance of the weight upon the individual. Appropriate breathing rhythms and sequences of different exercises can be utilized at the direction of the exercising individual or an exercise instructor to achieve the results desired for the exercising individual. One lower body curl exercise is illustrated in the included drawings along with words describing how the exercise tool can be utilized to isolate and work out the lower abdominal muscles (e.g. the transverse abdominis, rectus abdominis and the external and internal obliques, as well as the aponeurosis stomach muscle) around the lower stomach, for a particularly effective lower torso and stomach muscle work out. The exercise tool can also be used as a HIIT high intensity workout assistance device for upper and lower bodies while performing bicycles, push-ups, back arm squats, curls, etc.

OBJECTS OF THE INVENTION

Accordingly, a primary object of the present invention is to provide an exercise tool of simple and durable construction which supports at least one portion of a body of a user during the performance of a variety of exercises.

Another object of the present invention is to provide an exercise tool which provides for firm body support when resting upon an underlying horizontal surface.

Another object of the present invention is to provide an exercise tool which includes a padded source of support especially useful in supporting a back of a torso of the user while performing lower abdominal exercises.

Another object of the present invention is to provide an exercise tool which comfortably supports a user while the user is performing exercises.

Another object of the present invention is to provide a method for performing lower abdominal exercises in a highly effective fashion.

Another object of the present invention is to provide an exercise tool with hand grips which can accommodate hands/fingers in a variety of different orientations optimal for a variety of different exercises.

Another object of the present invention is to provide an exercise tool with handles having multiple bars thereon which can be gripped at different levels above a base of the tool to flexibly optimize and support for a variety of different exercises.

Another object of the present invention is to provide an exercise tool which is compact and portable and yet highly durable and able to support a user's entire body weight above ground in a stable fashion.

Other further objects of the present invention will become apparent from a careful reading of the included drawing figures, the claims and detailed description of the invention.

DESCRIPTION OF THE PREFERRED EMBODIMENT

Figure 1:
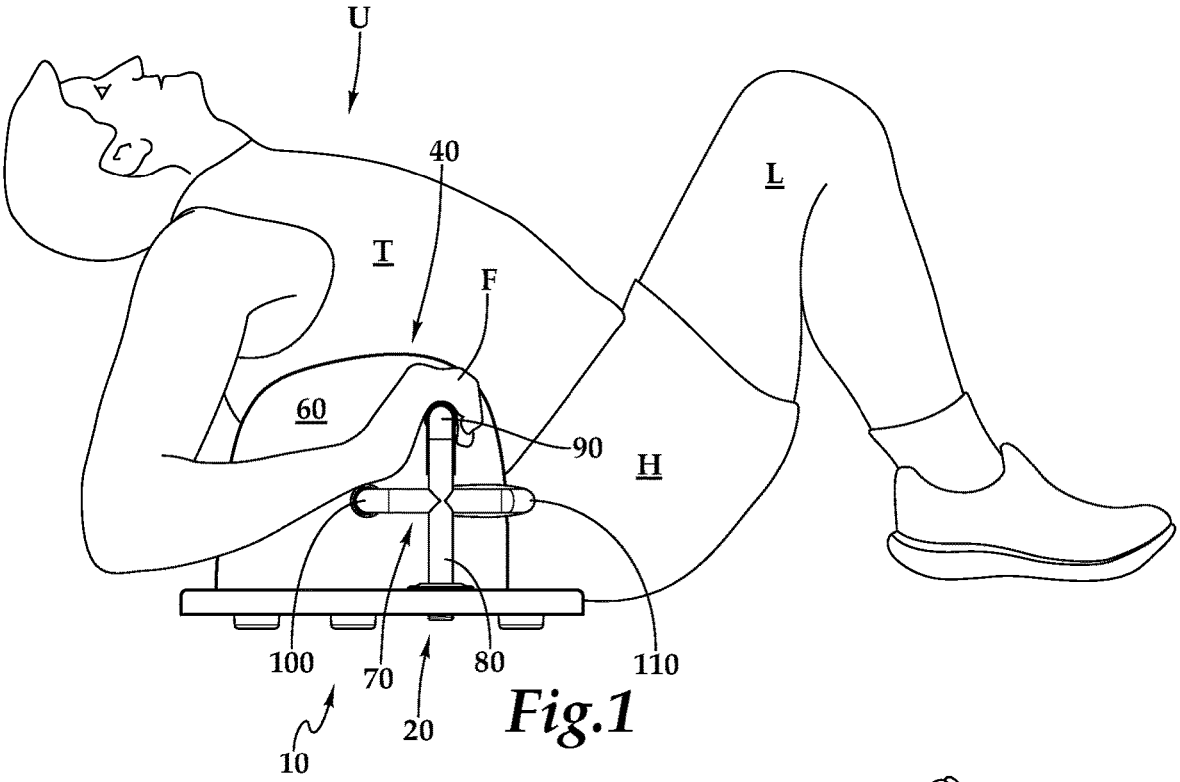
FIG. 1 is a side elevation view of the tool of this invention while being used by an individual who is ready to perform a lower abdomen strengthening exercise.
Figure 2:
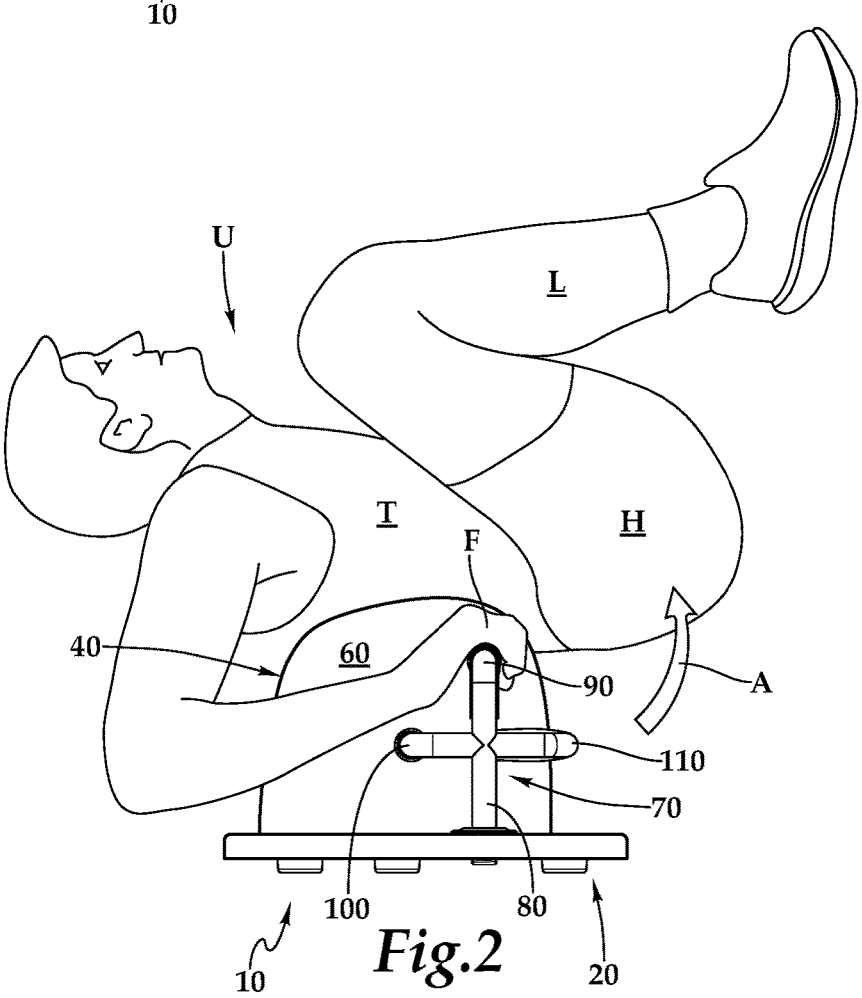
FIG. 2 is a side elevation view similar to that which is shown in FIG. 2, but after the lower abdominal strengthening exercise has transitioned to a second elevated lower body position.
Figure 3:
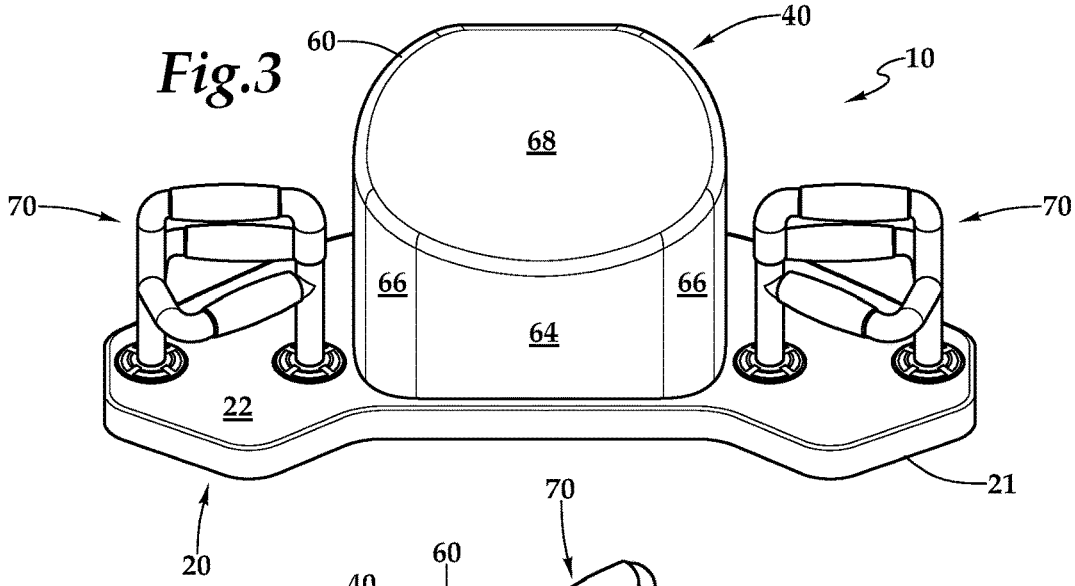
FIG. 3 is a perspective view from above and from a rear side of the exercise tool of this invention, according to one embodiment.
Figure 4:
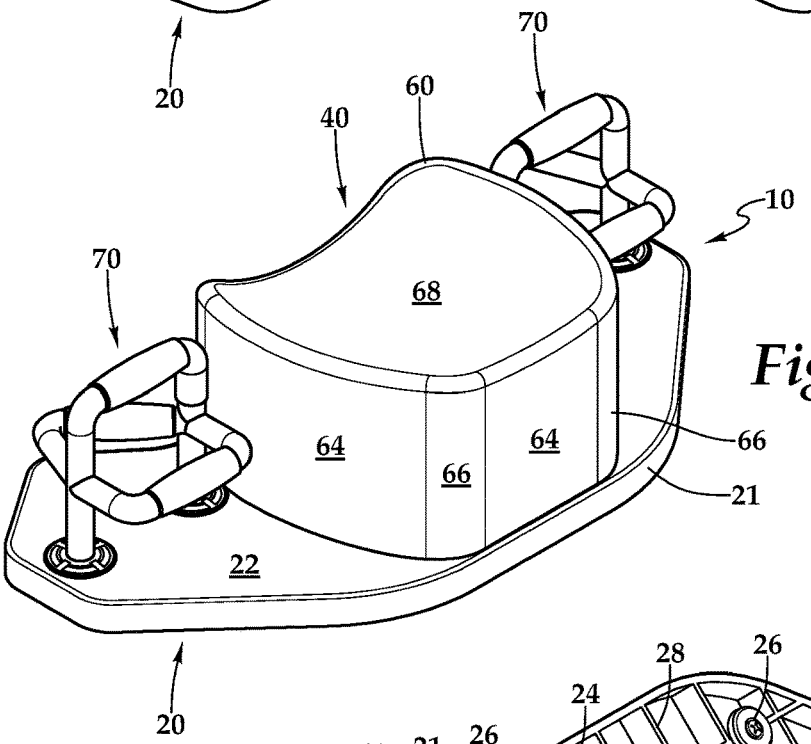
FIG. 4 is a perspective view of that which is shown in FIG. 3, from above and laterally.
Figure 5:
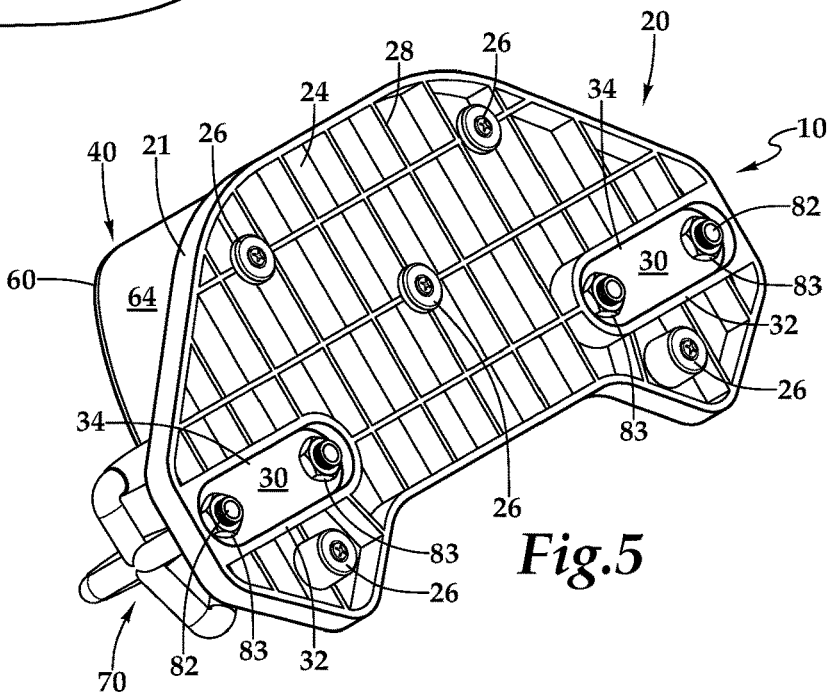
FIG. 5 is a perspective view of that which is shown in FIG. 3, from below and laterally.
Figure 6:
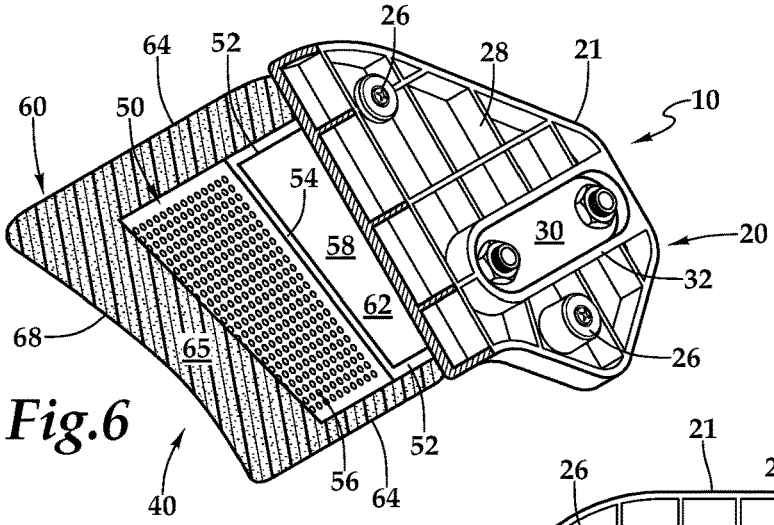
FIG. 6 is a perspective full sectional view of that which is shown in FIG. 5, revealing interior details of a torso support of the exercise tool of FIG. 3.
Figure 7:
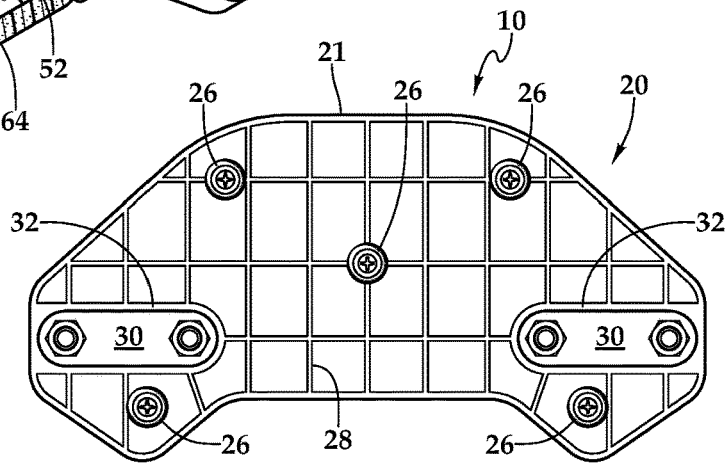
FIG. 7 is a bottom plan view of that as shown in FIG. 3.
Figure 8:
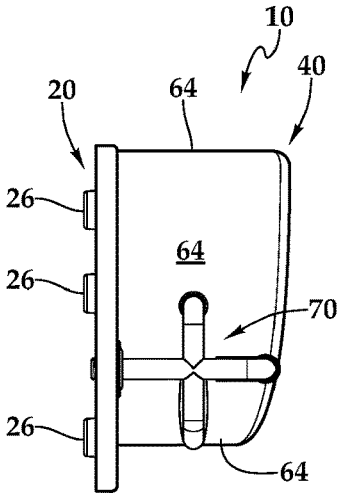
FIG. 8 is a side elevation view of that which is shown in FIG. 3.
Figure 9:
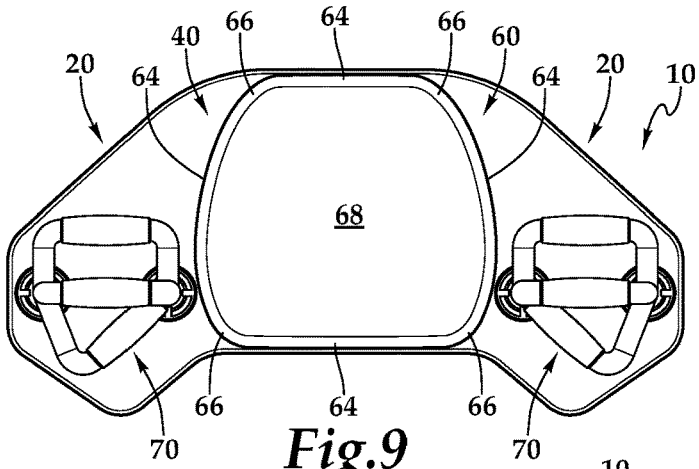
FIG. 9 is a top plan view of that which is shown in FIG. 3.
Figure 10:
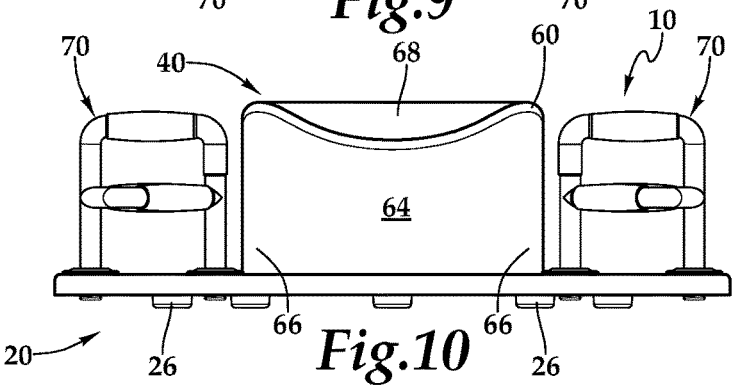
FIG. 10 is a rear elevation view of that which is shown in FIG. 3.
Figure 11:
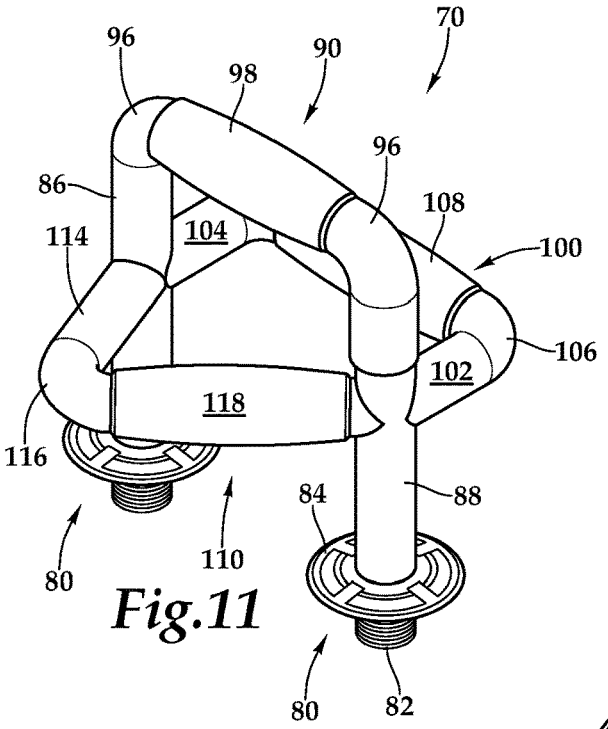
FIG. 11 is a perspective view of a handle according to one embodiment, usable with the exercise tool of FIG. 3.
Figure 12:
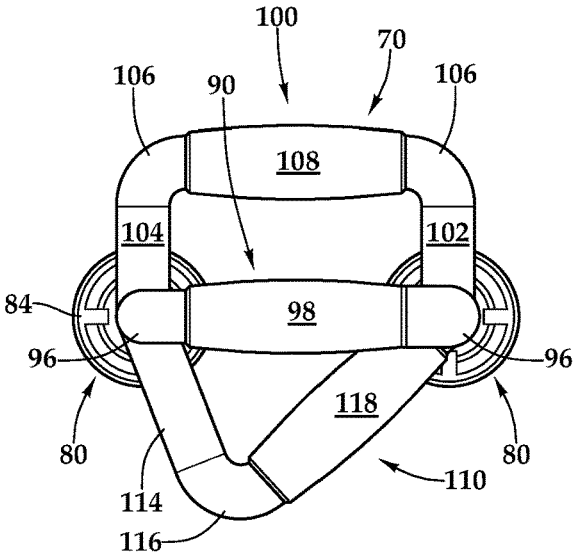
FIG. 12 is a top plan view of that which is shown in FIG. 11.
Figure 13:
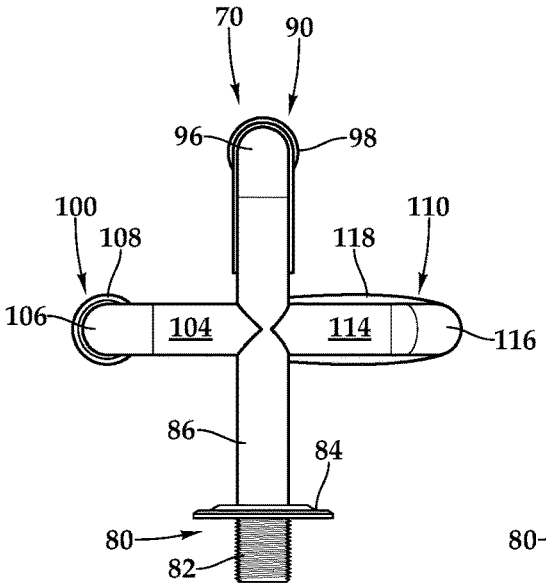
FIG. 13 as a side elevation view of that which is shown in FIG. 11.
Figure 14:
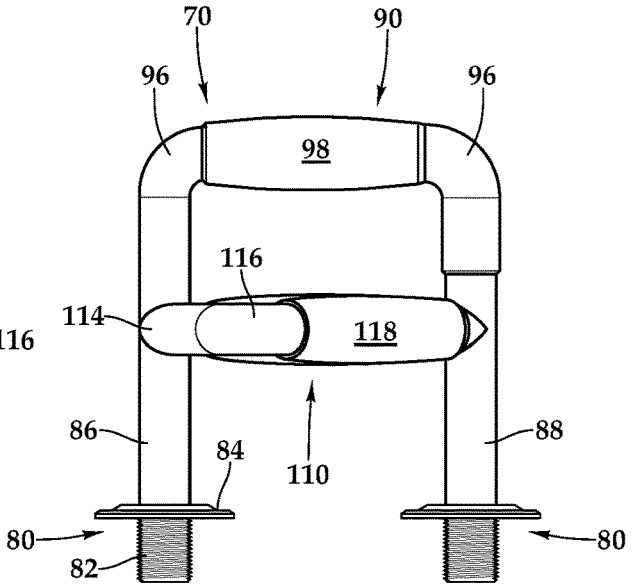
FIG. 14 is a rear elevation view of that which is shown in FIG. 11.

Referring to the drawings, wherein like reference numerals represent like parts throughout the various drawing figures, reference numeral 10 is directed to an exercise tool (FIGS. 1-4) which can be utilized for a variety of different exercises for a human user, and is especially configured to comfortably and firmly support a user while performing lower abdominal exercises (FIGS. 1 and 2).

In essence, and with particular reference to FIGS. 3-6, basic details of the exercise tool 10 are described, according to one example embodiment. The exercise tool 10 includes a base 20 of rigid form which in this embodiment is generally planar between a top surface 22 and bottom surface 24. Stiffeners 30 are located adjacent to the bottom surface 24 of the base 20 and interact with interfaces 80 of handles 70 extending up from lateral portions of the base 20. A torso support 40 extends up from the top surface 22 of the base 20. This torso support 40 includes a rigid frame 50 fixed to the top surface 22 of the base 20 and padding 60 on at least upper portions of the torso support 40. The handles 70 each include a top bar 90 extending between posts 86, 88 extending up from the interfaces 80. Parallel bars 100 and angled bars 110 also extend between these posts 86, 88 of each handle 70. With such a basic configuration, the handles 70 can support fingers F and hands (or feet) of a user, while the torso support 40 optionally provides for torso T support of a user U, or other body portions of the user U can be supported thereon, while performing various exercises.

More specifically, and with particular reference to FIGS. 3-7, details of the base 20 are described, according to this example embodiment. The base 20 is a rigid monolithic structure which can impart rigidity for the base 20, so that the performance associated with the base 20 can be maintained, but weight is conserved to make the tool 10 more portable in nature.

The base 20 has a somewhat elongate form between two lateral portions on either side of a central portion. Most preferably, the base 20 is generally bilaterally symmetrical and configured with the lateral portions providing for hand (or foot) support, while central portions of the base 20 provide for torso T support of a user U, at least for some exercises. The base 20 has a width defined as a lateral distance between the lateral portions and a depth defined by a distance between a front and rear of a perimeter 21 of the base 20, and with a height defined as a distance between the bottom surface 24 and feet 26 on one side, and the top surface 20 on an opposite side. One particular shape for the base 20 is similar to that depicted in the figures, such as FIG. 7.

The top surface 22 of the base 20 is generally planar and parallel with the bottom surface 24 in this embodiment. The top surface 22 could alternatively be domed or have other contours besides planar, but would still be generally opposite the bottom surface 24. The bottom surface 24 is preferably open so that ribbing 28 within the base 20 can be seen. The ribbing 28 in this embodiment includes lateral ribbing 28 and front-to-rear ribbing 28 perpendicular to the lateral ribbing 28. Lower edges of the ribbing 28 generally define the bottom surface 24.

Feet 26 preferably extend slightly below the bottom surface 24. These feet 26 can include increased friction knobs or other structures thereon, which can increase stability of the tool 10 and resistance to sliding of the tool 10 upon an underlying surface, and also can provide high wear characteristics to keep the feet 26 from deteriorating due to abrasion when rubbing against underlying surfaces during use. The feet 26 can optionally be removably replaced with feet 26 having other characteristics or to replace worn feet 26 with new feet 26. While a particular pattern and number of feet 26 are shown, other patterns, locations and numbers of feet can be provided extending from the bottom surface 24, or the bottom surface 24 could be provided without any feet 26, as one alternative.

Stiffeners 30 are preferably provided residing within recesses 32 adjacent each lateral portion of the base 20, and extending up into the bottom surface 24 of the base 20. These recesses 32 are preferably elongate in form with the shapes matching that of the stiffeners 30. The stiffeners 30 are elongate between ends 34. Holes pass through the ends 34 which can receive the interfaces 80 of the handles 70 passing therethrough after these interfaces 80 pass down through holes in the base 20 which extend down and terminate within the recesses 32.

The stiffeners 30 can be formed of steel or other high strength materials generally stronger than that of the base 20. The stiffeners 30 transfer forces from the handles 70 to the base 20 in a manner which causes the handle 70 to have a highly firm and secure rigidity relative to the base 20, even when supporting full weight of a user U and forces which might be imparted upon the handles 70 which go beyond weight forces of the user U, due to movement of the user U during performance of various exercises. Lower ends of the interfaces 80 of the handle 70 terminate at threaded tips 82 which extend down below the stiffeners 30. Nuts 83 are threadably attached to these threaded tips 82 until they abut against the stiffeners 30, to securely hold the handles 70 to the base 20 through these stiffeners 30.

With particular reference to FIGS. 3, 4, 6, 9 and 10, details of the torso support 40 are described, according to this embodiment of the exercise tool 10. The torso support 40 is configured to allow a torso T of a user U (FIGS. 1 and 2) to rest thereon during performance of various exercises. While in one embodiment it is a backside of the torso T which rests upon the torso support 40, it could be a side of the torso T or a front of the torso T, or could conceivably allow other portions of the body of the user U to rest thereon.

The torso support 40 includes a frame 50 with padding 60 overlying the frame 50. The frame 50 provides a rigid skeleton, while the padding 60 provides for a softer interface with the user U. The frame 50 includes riser walls 52 which extend up from the top surface 22 of the base 20 in a fixed manner, with the riser walls 52 terminating at a top plate 54. The top plate 54 spans multiple riser walls 52 at portions of the riser wall 52 opposite the top surface 22 of the base 20. The top plate 54 is preferably angled so that it is slightly lower adjacent to a rear of the base 20 that it is adjacent to a front of the base 20. This top plate 54 is shown in this embodiment being generally planar. Fenestrations 56 pass through the top plate 54 and help to allow for breathing of cells within the padding 60, and to allow for the padding 60 to more readily flex without air being trapped therein, and to avoid trapping of stale air. Open space 58 is provided beneath the top plate 54, which helps to decrease weight of the overall exercise tool 10.

The padding 60 has a contour somewhat following that of the frame 50, with a hollow core 62 fitting over the frame 50. In this embodiment, the padding 60 surrounds both an upper side of the frame 50 and lateral sides of the frame 50, but in other embodiments, at least portions of the top plate 54 of the frame 50 are covered by the padding 60. The padding 60 includes a skirt 64 extending down from an upper surface 68. The skirt 64 includes corners 66 where more planar portions of the padding 60 are joined together. A cushion region 65 (FIG. 6) defines a core of the padding 60 which can resiliently flex in thickness, allowing the upper surface 68 and other portions of the padding 60 to deflect and adjust in shape to a contour of surfaces of a torso T of a user U, to provide comfort and support for the user U. Preferably, the skirt 64 extends all the way down to the top surface 22 of the base 20. Upper portions of the skirt 64 transition at corners and edges into the upper surface 68.

The upper surface 68 preferably is contoured slightly, somewhat like a saddle for the torso T of the user U. This contour is most preferably concave in nature and either being more of a cylindrical concave form or a slightly spherical concave form. With a more cylindrical concave form, lateral portions of the upper surface 68 are raised slightly and provide lateral support for the torso T of the user U during performance of various exercises. This helps to keep the user U centered upon the torso support 40 during motion. Most preferably, a rearward facing portion of the torso support 40 is slightly lower than a more forward facing portion of the torso support 40. The upper surface 68 is preferably close to horizontal (e.g. angled less than 15°) and sufficiently frictional in surface characteristics that a user U does not tend to slide upon the upper surface 68 when resting thereon. Furthermore, the handles 70 are provided to allow a user U to remain centered upon the exercise tool 10 during use, and without sliding off of the torso support 40. The padding 60 can be secured (permanently or removably) to the frame 50 and/or are 20, or can merely rest over the frame 50.

With particular reference to FIGS. 11-15, details of the handles 70 are described, according to this embodiment. The handles 70 include posts 86, 88 which extend by way of interfaces 80 below the base 20 and below stiffeners 30, for securing of the handles 70 to the base 20 of the tool 10. A flange 84 is provided on each of the posts 86, 88 on upper portions of the interfaces 80. This flange 84 is larger than holes passing through the base 20 which received the threaded tips 82 passing therethrough. The flange 84 acts as a stop and a bearing surface, which can sandwich the base 20 and stiffeners 30 between the flange 84 and nut 83, for secure attachment of the handles 70 to the base 20.

The posts 86, 88 have three bars 90, 100, 110 extending therebetween. These bars 90, 100, 110 include a top bar 90, a parallel bar 100 and an angled bar 110. These bars 90, 100, 110 allow for fingers F of a user U to grip the handles 70 in a variety of different ways for support of the user U relative to the base 20.

The top bar 90 preferably extends between uppermost portions of the posts 86, 88 in a horizontal fashion. The top bar 90 preferably extends along a line which is co-linear with the top bar 90 of the other handle 70 at the opposite lateral side of the base 20. This top bar 90 is preferably perpendicular to a plane about which the exercise tool 10 is bilaterally symmetrical. The top bar 90 is preferably closer to an elevation of the upper surface 68 of the padding 60 of the torso support 40 than to an elevation of the top surface 22 of the base 20, but slightly below this upper surface 68. Alternatively, the top bar 90 could be above the upper surface 68.

The top bar 90 includes bends 96 which support ends of the top bar 90 and a grip 98 which provides an elevated friction and padded structure for grabbing by fingers F of the user U. The grip 98 can be built into the top bar 90 or removably attachable to the top bar 90 as a separate structure, such as a resilient sleeve with a slit which can snap over the top bar 90. As an alternative, the grip 98 could be formed of tape adhesively wrapped onto the top bar 90. This configuration for the top bar 90 is particularly disclosed.

The parallel bar 100 is lower than the top bar 90 but parallel with the top bar 90. This parallel bar 100 extends away from the posts 86, 88 through an inner short arm 102 and an outer short arm 104 which terminate at bends 106 at ends of the parallel bar 100. A grip 108 is located on the parallel bar 100 functioning similar to the grip 98 on the top bar 90. The parallel bar 100 is lower than the top bar 90 and closer to the top surface 22 of the base 20 than is the top bar 90. This parallel bar 100 is also preferably closer to a forward side of the base 20 than to a rearward side of the base 20. The parallel bar 100 provides a secondary location for gripping by fingers F of a user U, so when a user U desires to grip the exercise tool 10 through the handles 70, at a lower portion of the handles 70, such a lower grip 108 is provided than through the top bar 90.

The angled bar 110 is preferably at a similar elevation to the parallel bar 100, but located on a more rearward side of the base 20 opposite the parallel bar. The angled bar 110 is supported through a bend 116 and an outer arm 114 away from the outer post 86, and with the angled bar 110 directly attached to the inner post 88. A grip 118 is provided on the angled bar 110 which is generally similar to the grips 98, 108 of the top bar 90 and parallel bar 100. Angled bar 110 provides an alternative angle skewed relative to both the top bar 90 and parallel bar 100, angled in a non-parallel fashion which can be desirable for gripping with fingers F of the user U when performing a variety of exercises.

In use and operation, and with particular reference to FIGS. 1 and 2, details of the function of the exercise tool 10 are described, according to at least one embodiment for this invention. When desiring to strengthen lower abdominal muscles of a user U, it is often desirable to elevate the torso T above ground, and then rotate hips H and legs L of the user U in a repeating fashion (along arrow A of FIG. 2). It is desirable that the hips H can extend quite low, but still remain above ground, and it is also desirable that a backside of a torso T of the user U be supported but in a manner which avoids discomfort.

The tool 10 of this invention is ideal for performing such an exercise. The user U places a backside of the torso T resting upon the upper surface 68 of the padding 60 on the torso support 40. The user U has hips H and legs L on a more rearward side of the tool 10 which can initially be resting upon ground. Fingers F of the user U can grip the top bar 90 or parallel bar 100 to help stabilize the user U. The user U can then elevate the hips H and legs L above ground, and continue to elevate the hips H and legs L to a highly elevated position (along arrow A of FIG. 2). The hips H and legs L can then be rotated downward while the torso T is arched against the padding 60 of the torso support 40. Preferably, hips H and legs L remain above ground and the exercise is repeated multiple times. Such a lower abdominal exercise is difficult or impossible to perform with other exercise equipment.

Before such an exercise performed, a user U will typically carry the lightweight portable exercise tool 10 to a location where the exercise is to be performed, and place the exercise tool 10 resting upon an underlying horizontal surface. Once so positioning the exercise tool 10, a large number of different exercises can be performed. With some exercises, some portion of the torso T of the user U is resting upon the torso support 40. Simultaneously, at least one hand of the user U can grip at least some portion of the handles 70, such as through fingers F of the user U.

With some exercises, only the handles 70 are utilized. For instance, push-ups can be performed merely utilizing the handles 70 and without utilizing the torso support 40. The handles 70 can also be utilized as foot supports by placing toes of a user U beneath the parallel bar 100 or angled bar 110, so that feet of the user U are anchored somewhat during performing of the sit ups or crunches, or similar exercises. The tool 10 can also be utilized as a curling bar where the user U is standing, by the user gripping the handles 70 with fingers F of the user U and performing a curl. Other forms of standing exercises can also be performed, with the exercise tool 10 providing some weight with which to perform repeated exercises.

While the number and type of exercises which can be performed is essentially limitless, one partial list of exercises which can be effectively performed with exercise to have this invention include: reverse crunch (no weight and weighted); reverse crunch-cross legged; upper crunch (no weight and weighted); twisting sit ups; side crunch (no weight and weighted); weighted Russian twist (no weight and weighted); flutter kicks (no weight and weighted); dragon flag variation flutter kicks (no weight and weighted); jack knives (no weight and weighted); jack knives bent knees (no weight and weighted); bicycles (no weight and weighted); plank and knees to chest (no weight and weighted); plank-one leg lift (no weight and weighted); plank-rotation and extension; plank-weighted; plank-single arm; plank-side crunches; plank-reverse hip lift; plank jacks; bird dog plank; leg circles (no weight and weighted); Swiss ball jack knife; slider knee pike; cross body climber (no weight and weighted); jack knife-cross leg (no weight and weighted); reverse medicine ball plank; medicine ball float; superman; superman with medicine ball; push-ups; back arm; and curls.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An exercise tool comprising in combination:

a base having a planar bottom surface and a top surface opposite said bottom surface;

a torso support extending upward from said top portion of said base; and a pair of handles coupled to said base and extending upward from said top surface of said base, with said handles on opposite lateral sides of said torso support;

wherein each of said handles includes a plurality of bars grabbable by hands of an individual utilizing the exercise tool;

wherein each of said handles includes a pair of vertically extending posts with each of said plurality of bars extending between said two posts.

2. The exercise tool of claim 1 wherein said plurality of bars includes a top bar joining upper ends of said posts together, and a parallel bar and an angled bar, said parallel bar and said angled bar oriented within a common plane beneath said top bar.

3. The exercise tool of claim 2 wherein said top bar and said parallel bar extend along lines parallel with each other and with said angled bar angled relative to said top bar and said parallel bar.

4. The exercise tool of claim 1 wherein said torso support includes a rigid frame with an angled top plate which is oriented in a non-horizontal plane when said base has its bottom surface oriented horizontally.

5. The exercise tool of claim 4 wherein said torso support includes padding overlying said top plate of said torso support.

6. The exercise tool of claim 5 wherein said padding includes a top saddle surface which is semi-cylindrical in form with lateral sides which are higher than a central portion thereof.

7. The exercise tool of claim 6 wherein said padding includes a hollow core, into which said frame of said torso support fits.

8. An exercise tool, comprising in combination:

a base, said base having a planar bottom surface and a top surface opposite said bottom surface;

said base wider between lateral portions thereof than it is deep between front and rear portions thereof, and wider than it is tall;

said base having a central portion between said lateral portions, with a torso support extending up from said top surface of said base at said central portion;

a pair of handles extending up from said top surface of said base, one of said handles at each of said lateral portions of said base;

said torso support having padding on at least an upper portion thereof; and said padding having a contoured non-planar upper surface.

9. The tool of claim 8 wherein said upper surface of said padding of said torso support has at least a portion thereof which has a concave cylindrical form.

10. The tool of claim 8 wherein said upper surface of said padding includes at least a portion of which having a concave form.

11. The tool of claim 10 wherein a frame is located inside of said torso support and beneath said upper surface of said padding, said frame having a rigid form and fixed to said top surface of said base.

12. The tool of claim 11 wherein said frame includes an angled top plate non-parallel with said top surface of said base.

13. The tool of claim 12 wherein said top plate of said frame includes fenestrations therein.

14. The tool of claim 8 wherein each of said handles has multiple grippable bars thereon.

15. The tool of claim 14 wherein each of said handles includes a top bar which is located closer to an elevation of said upper surface of said padding of said torso support than to an elevation of said top surface of said base.

16. The tool of claim 15 wherein each of said handles includes a parallel bar which is parallel with said top bar and located closer to said top surface of said base than to said top bar.

17. The tool of claim 16 wherein each of said handles includes an angled bar, said angled bar non-parallel with said top bar and co-planar with said parallel bar.

18. A method for performing a lower abdomen exercise, including the steps of:

resting a backside of a torso of a user upon a torso support of an exercise tool, the exercise tool having a base, the base having a planar bottom surface and a top surface opposite the bottom surface, the base wider between lateral portions thereof than it is deep between front and rear portions thereof, and wider than it is tall, the base having a central portion between the lateral portions, with a torso support extending up from the top surface of the base at the central portion, a pair of handles extending up from the top surface of the base, one of the handles at each of the lateral portions of said base, the torso support having padding on at least an upper portion thereof, and the padding having a contoured non-planar upper surface;

gripping one of the pair of handles with a left hand of the user and one of the handles with a right hand of the user; and repeatedly lifting and lowering hips and legs of the user relative to the torso of the user.

* * * * *